US006321923B1

(12) United States Patent
Wood

(10) Patent No.: US 6,321,923 B1
(45) Date of Patent: Nov. 27, 2001

(54) BISTABLE HINGE WITH REDUCED STRESS REGIONS

(75) Inventor: Christopher J. Wood, Greenfield, WI (US)

(73) Assignee: Seaquist Closures Foreign, Inc., Crystal Lake, FL (US)

( * ) Notice: Subject to any disclaimer, the term of this patent is extended or adjusted under 35 U.S.C. 154(b) by 0 days.

(21) Appl. No.: 09/559,211

(22) Filed: Apr. 26, 2000

(51) Int. Cl.[7] ..... B65D 43/14

(52) U.S. Cl. ..... 215/235; 220/836; 220/838; 16/225; 16/DIG. 13

(58) Field of Search ..... 16/225, DIG. 13; 215/235; 220/836–839, 847; 222/498, 556

(56) References Cited

U.S. PATENT DOCUMENTS

| | | | | |
|---|---|---|---|---|
| 1,928,445 | | 9/1933 | Boyd . | |
| 3,110,410 | | 11/1963 | Pehr . | |
| 3,135,456 | | 6/1964 | Palazzolo . | |
| 3,629,901 | * | 12/1971 | Wolf et al. | 220/838 X |
| 4,403,712 | | 9/1983 | Wiesinger . | |
| 4,414,705 | * | 11/1983 | Ostrowsky . | |
| 4,457,458 | * | 7/1984 | Heinol . | |
| 4,545,495 | | 10/1985 | Kinsley . | |
| 4,573,600 | | 3/1986 | Dubach . | |
| 4,726,091 | | 2/1988 | Joyce . | |
| 4,778,071 | | 10/1988 | Fillmore . | |
| 4,793,501 | | 12/1988 | Beck . | |
| 4,813,560 | * | 3/1989 | Begley . | |
| 4,854,473 | * | 8/1989 | Dubach | 22/838 |
| 5,067,624 | | 11/1991 | Thanisch . | |
| 5,115,931 | | 5/1992 | Dubach . | |
| 5,143,234 | | 9/1992 | Lohrman et al. . | |
| 5,356,017 | | 10/1994 | Rohr et al. . | |
| 5,386,918 | * | 2/1995 | Neveras et al. | 215/235 |
| 5,423,442 | | 6/1995 | Nozawa et al. . | |
| 5,435,456 | * | 7/1995 | Dubach | 220/838 |
| 5,489,035 | | 2/1996 | Fuchs . | |
| 5,501,348 | | 3/1996 | Takeuchi . | |
| 5,531,349 | | 7/1996 | Wojcik . | |
| 5,540,343 | | 7/1996 | Schumacher . | |
| 5,558,239 | | 9/1996 | Dubach . | |
| 5,588,546 | | 12/1996 | Farside . | |
| 5,620,107 | | 4/1997 | Takeuchi . | |
| 5,632,417 | | 5/1997 | Robbins, III et al. . | |
| 5,642,824 | | 7/1997 | Hess, III et al. . | |
| 5,667,094 | * | 9/1997 | Rapchack et al. | 220/839 X |
| 5,755,352 | | 5/1998 | Wojcik et al. . | |
| 5,762,216 | | 6/1998 | Takeuchi . | |
| 5,785,193 | | 7/1998 | Kobayashi et al. . | |
| 5,865,353 | | 2/1999 | Baudin . | |
| 5,913,435 | | 6/1999 | Fuchs . | |
| 6,041,477 | * | 3/2000 | Rentsch et al. | 220/839 X |
| 6,152,320 | * | 11/2000 | Hierzer et al. | 220/838 |

FOREIGN PATENT DOCUMENTS

| | | |
|---|---|---|
| GUM 1960247 | 2/1967 | (DE) . |
| 42 39 299 A1 | 3/1994 | (DE) . |
| 0 590 325 A2 | 4/1994 | (EP) . |
| 0 631 942 A1 | 1/1995 | (EP) . |
| WO 94/20713 | 9/1994 | (WO) . |

OTHER PUBLICATIONS

Sketch A.
Sketch B.

* cited by examiner

*Primary Examiner*—Allan N. Shoap
*Assistant Examiner*—Robin A Hylton
(74) *Attorney, Agent, or Firm*—Rockey, Milnamow & Katz, Ltd.

(57) ABSTRACT

A closure is provided for a container opening. The closure includes a base for mounting to the container and a lid movable between a closed position and an open position. The lid and base are connected by a bistable, snap-action hinge structure having a web with a reduced thickness region along a lateral edge.

17 Claims, 8 Drawing Sheets

BISTABLE HINGE WITH REDUCED STRESS REGIONS

TECHNICAL FIELD

This invention relates to a hinge structure for connecting two members, and the hinge structure is particularly suitable for joining a container closure lid to the container closure body.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. One type of closure for these kinds of containers typically has a bistable hinge structure connecting a lid to a base mounted over the container opening. The hinge structure has a snap-action biasing force which maintains the lid in a selected closed or open position.

One type of bistable hinge structure incorporated in a closure is disclosed in U.S. Pat. No. 3,135,456. This patent discloses a snap-action hinge structure comprising a thin hinge web joining a base and a lid to accommodate movement of the lid between an open and closed position. The hinge structure has two, spaced-apart pivot axes. In particular, the hinge structure incorporates two, spaced-apart hinges, one hinge having an arcuate configuration connecting the lid to the hinge web and the other hinge having an arcuate configuration connecting the base to the hinge web. The two pivot axes are defined by two parallel lines wherein, at points where the two hinges are closest to each other, one line is tangent to the lid hinge and the other line is tangent to the body hinge.

In contrast, the hinge structure for a cylindrical closure disclosed in U.S. Pat. No. 4,403,712 has a single, main geometric axis hinge and has two webs which each is defined by two hinges which diverge on either side of the web. In commercial embodiments of the cylindrical closure having a single axis hinge structure disclosed in the U.S. Pat. No. 4,403,712, the hinge thickness changes along the length of the hinges. The thickness transition regions can define stress risers which may ultimately have a deleterious effect upon the structure during repeated operation.

Also, in some commercial closures which are sold by Seaquist Closures, 711 Fox Street, Box 20, Mukwanago, Wis. 53149, U.S.A., and which include the single axis hinge structure disclosed in U.S. Pat. No. 4,403,712, the web is provided with an increased thickness region adjacent to the lateral edge of the web.

A snap-action hinge structure with significant improved operating characteristics compared to the hinge structures disclosed in the U.S. Pat. Nos. 3,135,456 and 4,403,712 is a dual axis hinge structure disclosed in the U.S. Pat. No. 5,642,824. The hinge structure is of the type that includes a web having a central portion between two wider ends wherein an arcuate hinge connects the base to the web along one side of the web between the ends and wherein an arcuate hinge connects the lid to the web along another side of the web between the ends. The hinge structure includes at least one abutment surface located so that when the lid is in the closed position, the abutment surface extends adjacent the web central portion from near one of the hinges toward the other hinge. During the closing and opening of the lid, the abutment surface is contacted by the web central portion whereby the position of the web is controlled.

Although the dual axis hinge structure disclosed in U.S. Pat. No. 5,642,824 functions with improved operating characteristics, there are some applications, such as those involving a large number of opening and closing cycles, in which the dual axis hinge structure, as well as other biased hinge structures or bistable, snap-action hinge structures, may be more likely to fail or break.

It is believed that in a snap-action hinge structure which includes a web having a wide end, the stresses are unevenly distributed along the lateral edge of the web end. This is thought to increase the stresses where the lateral edge connects with the closure body and lid. Failure or fracture of such hinge structures is typically initiated at those regions where a lateral edge of the hinge structure web connects with the closure body and/or lid.

Thus, it would be desirable to provide an improved snap-action hinge design in which the stresses in the hinge structure could be more carefully controlled. In particular, it would be beneficial if such an improved design could provide a selected or improved distribution of stress along the outer, lateral edges of the hinge structure.

It would be especially desirable to provide a hinge structure which would have reduced stresses where the hinge structure web lateral edges connect with the closure body and/or lid.

An improved hinge structure design should also permit the hinge structure to provide the desired opening and closing angle range for the lid. A hinge structure with such a capability can provide performance features that are desirable in particular applications.

Also, it would be desirable if such an improved hinge structure could be readily incorporated in a closure that would accommodate efficient, high quality, large volume manufacturing techniques with a reduced product reject rate.

Further, such an improved hinge structure should advantageously accommodate its use in closures with a variety of conventional containers having a variety of conventional container finishes, such as conventional threaded or snap-fit attachment configurations.

The present invention provides an improved hinge structure which can accommodate designs having the above-discussed benefits and features.

SUMMARY OF THE INVENTION

According to the present invention, a hinge structure is provided for connecting two members, and the hinge structure is particularly suitable for use in connecting a closure lid to the base of the closure wherein the closure is adapted to be mounted to, or formed as a unitary part of, a container. The hinge structure has enhanced resistance to fracture or failure. The improved resistance to failure results from a configuration that provides a particular distribution of stress along the outer edges of the hinge structure and a concomitant reduction in stress at the points where the outer edges of the hinge structure are connected to the two members, such as a closure body and a closure lid.

The hinge structure is a biased, bistable, snap-action hinge structure. The hinge structure is a continuous structure that is molded unitary with the two members, such as the closure lid and the closure base.

The hinge structure includes a web having a narrow portion and at least one lateral edge. The hinge structure also includes a hinge connecting one of the members to the web along one side of the web. The hinge structure includes another hinge connecting the other of the members to the web along another side of the web.

The web has a region of reduced thickness. The reduced thickness region is located between, and is reduced in thickness relative to, the two hinges. The reduced thickness region extends to the lateral edge.

In a preferred embodiment, the reduced thickness region is defined by a generally trapezoid shaped recess having one side along the lateral edge of the web. In a presently most preferred embodiment, the web has a substantially uniform thickness except for the reduced thickness region which has a thickness which is about one third less than the remaining portion of the web thickness.

In one preferred use of the hinge structure of the present invention, the hinge structure is included in a closure provided for an opening to a container interior. The closure includes a base for mounting to the container over the opening. The base defines a discharge aperture communicating with the opening. The closure includes a lid movable between a closed position occluding the aperture and an open position spaced from the aperture. The bistable, snap-action hinge structure connects the lid to the base.

The hinge structure includes a web having a narrow, central portion between two wider ends which each defines a lateral edge. The hinge structure also includes an arcuate hinge connecting the lid to the web along one side of the web between the lateral edges. The hinge structure includes another arcuate hinge connecting the closure base to the web along another side of the web between the lateral edges.

The web has two spaced-apart regions of reduced thickness. The reduced thickness regions are located between, and are reduced in thickness relative to, the arcuate hinges. Each reduced thickness region extends to one of the adjacent, lateral edges.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, a closure incorporating the hinge structure of this invention is described in various positions, and terms such as upper, lower, horizontal, etc., are used with reference to these positions. It will be understood, however, that the closure may be manufactured, stored, and used in orientations other than the ones described.

With reference to the figures, a first embodiment of a hinge structure of the present invention is illustrated in FIGS. 1–8 as incorporated in a closure represented generally in some of those figures by reference number 40.

The closure 40 is adapted to be disposed on a container, such as a container 42 (FIG. 3) which has a conventional mouth or opening (not visible) formed by a neck 43 (FIG. 3) or other suitable structure. The container neck 43 may have a circular or non-circular cross-sectional configuration, and the body of the container 42 may have another cross-sectional configuration, such as an oval cross-sectional shape, for example. The closure 40 is molded from a thermoplastic material compatible with the container contents.

Figure 1:
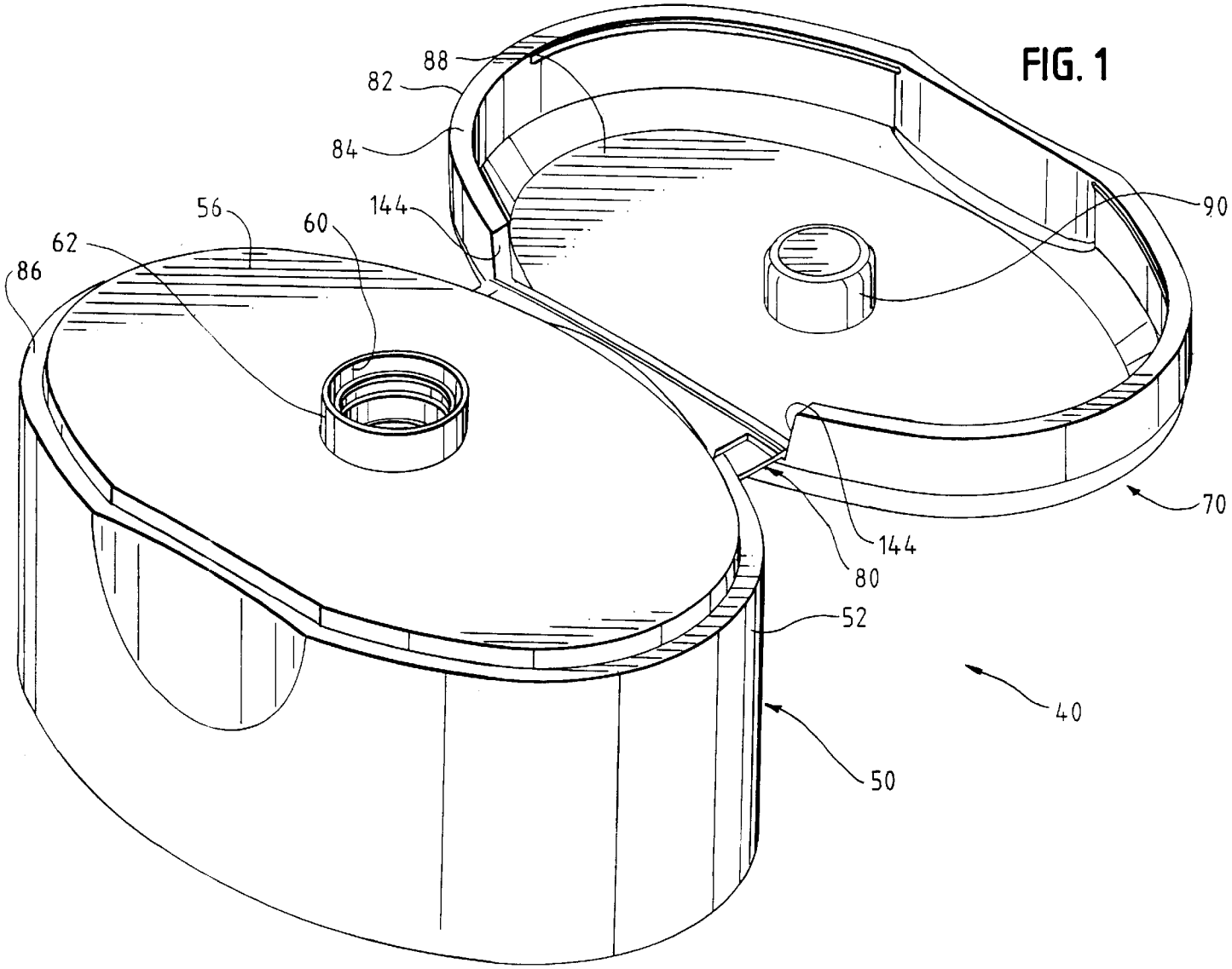
FIG. 1 is a perspective view of a first embodiment of a hinge structure of the present invention as incorporated in a closure shown in the as-molded open position.

The container 42 may be stored and used in the orientation shown in FIG. 1 wherein the closure 40 is at the top of the container 42. The container 42 may also be normally stored in an inverted position (not illustrated). When stored in the inverted position, the container 42 employs the closure 40 as a support base.

The container 42 is typically a squeezable container having a flexible wall or walls which can be grasped by the user and compressed to increase the internal pressure within the container 42 so as to squeeze the product out of the container when the closure 40 is opened (as explained in detail hereinafter). The container wall typically has sufficient, inherent resiliency so that when the squeezing forces are removed, the container wall returns to its normal, unstressed shape.

The closure 40 includes a base or body 50 for being mounted to the container neck 43. The base 50 includes a skirt 52 (FIG. 3) which has a conventional snap-fit bead or groove (not visible) or other suitable means for engaging suitable cooperating means, such as a mating bead or grove (not visible) on the container neck 43 to secure the closure base 50 to the container 42. The closure body 50 could alternatively include an interior, annular connector wall with internal threads for engaging external threads on the container neck 43.

At the top of the closure base skirt 52, the closure base 50 has a transverse deck 56 (FIG. 5) which extends over the upper, distal end of the container neck 43. The deck 56 typically has a downwardly extending, annular, internal flexible seal (not visible) which is received against the inner edge of the container neck 43 in the container neck opening so as to provide a leak-tight seal between the closure base deck 56 and the container neck 43.

Figure 2:
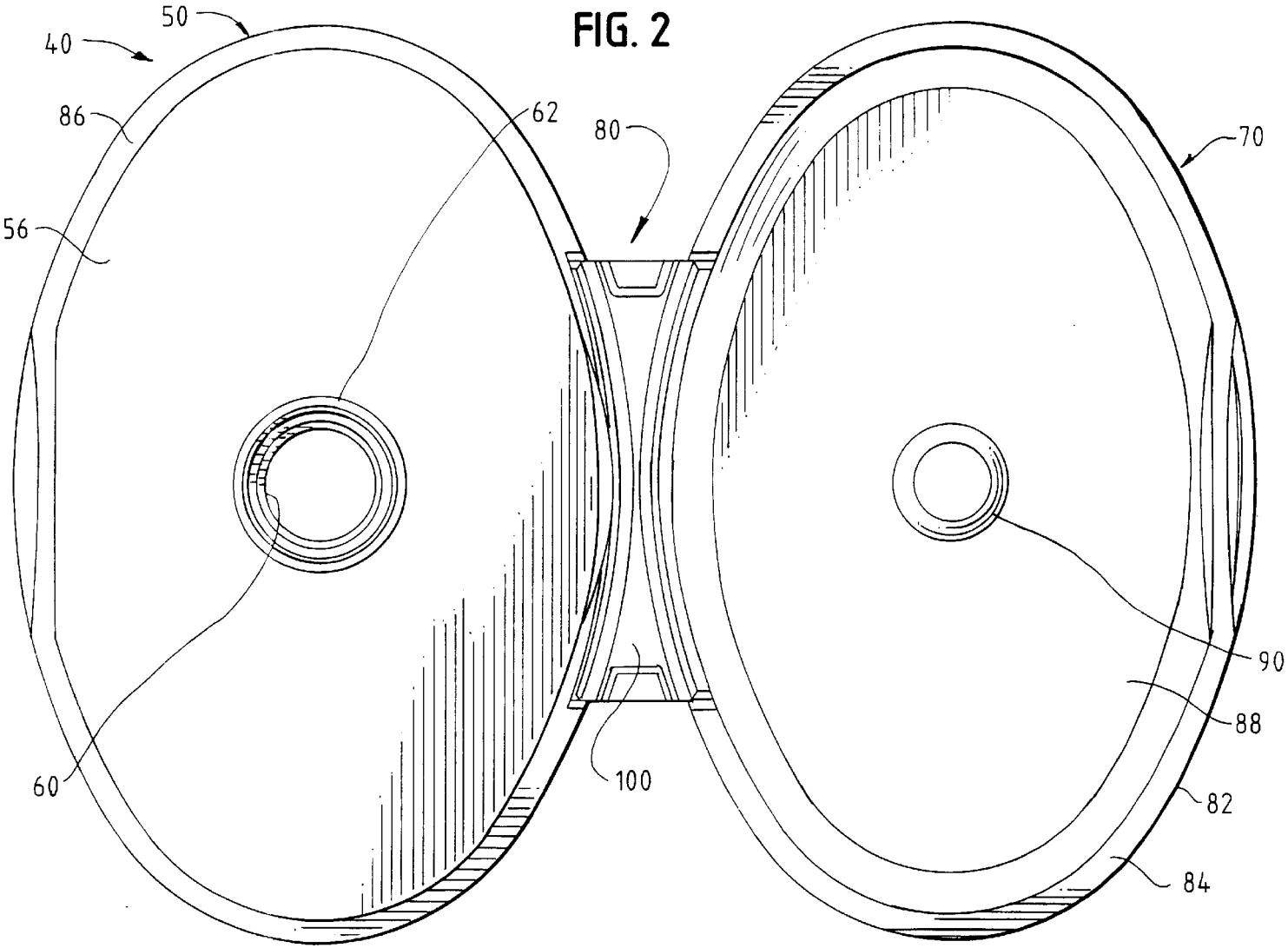
FIG. 2 is a top plan view of the closure in the fully open, as-molded condition.
Figure 3:
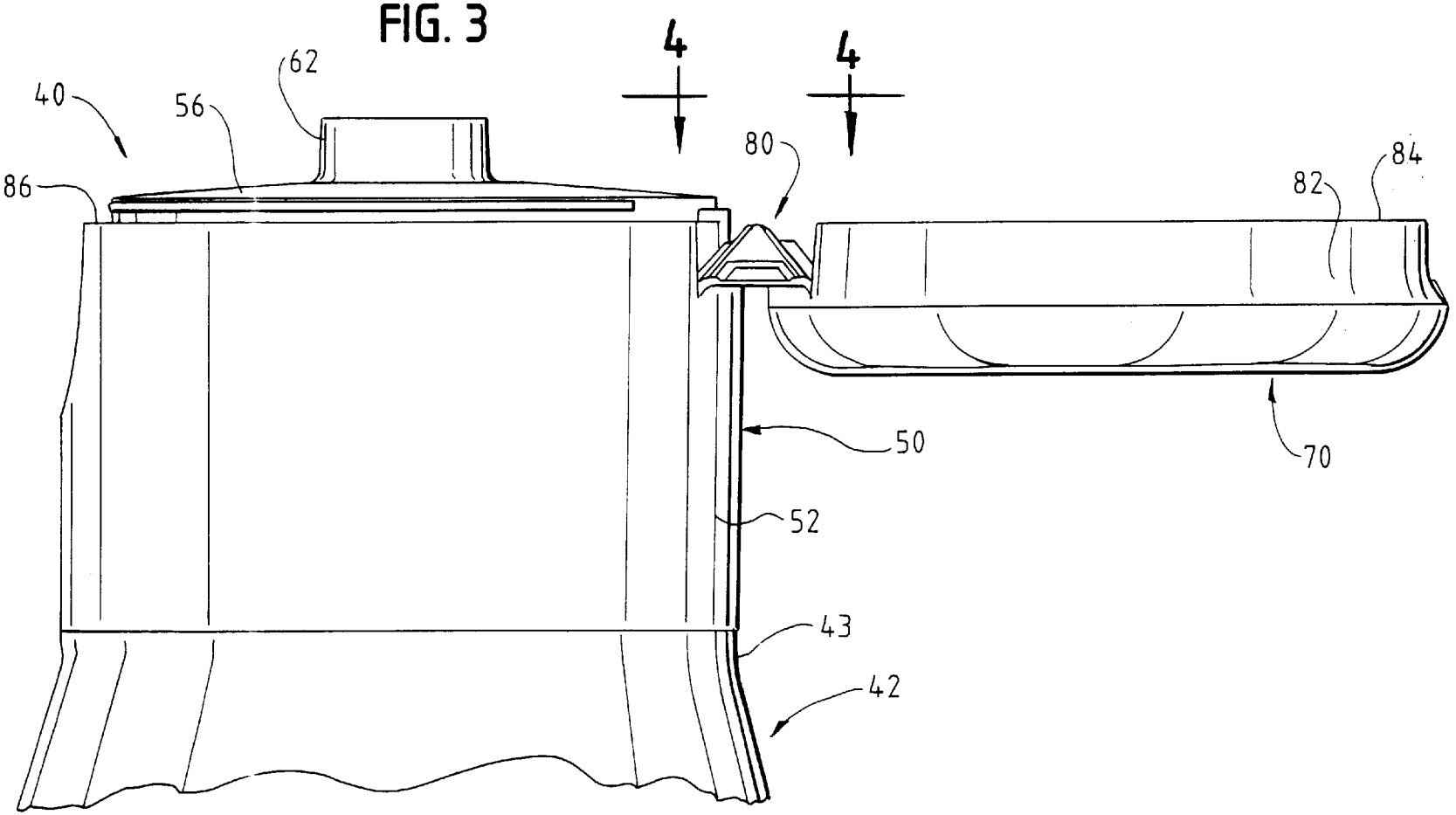
FIG. 3 is a side elevational view of the closure shown in the as-molded open condition and mounted on a container.

As illustrated in FIGS. 1–3, the closure base deck 56 has a spout 62 projecting upwardly to define a discharge aperture 60 over the container neck opening.

The closure 40 includes a lid 70 (FIGS. 1–3) connected to the base 50 with a hinge structure 80. The lid 70 includes a peripheral skirt 82 (FIG. 1) defining a peripheral termination surface 84. The lid peripheral surface 84 is adapted to contact, or at least confront, the closure base 50 when the lid 70 is closed. Preferably, as illustrated in FIG. 1, the closure base 50 defines a peripheral shoulder 86 recessed below the main portion of the deck 56, and the recessed shoulder 86 confronts the surface 84 of the lid skirt 82 when the lid 70 is closed.

The closure lid 70 includes a transverse deck or cover 88 (FIG. 1). Extending from the underside of the lid cover 88 is an annular member 90 which is adapted to be received in, and sealingly engage the interior of, the closure base spout 62 when the lid 70 is closed.

In the preferred embodiment, the hinge structure 80 is integrally molded as a unitary part of the closure with the base 50 and lid 70. One preferred material for molding the closure is polypropylene. It has been found that this material provides a relatively strong, durable closure. The material functions in the hinge structure 80 with desirable biasing forces, has the capability for withstanding typical loads imposed by a user of the closure when the user opens and closes the lid 70, and has the capability for accommodating a relatively high number of opening and closing cycles without failure.

Figure 4:
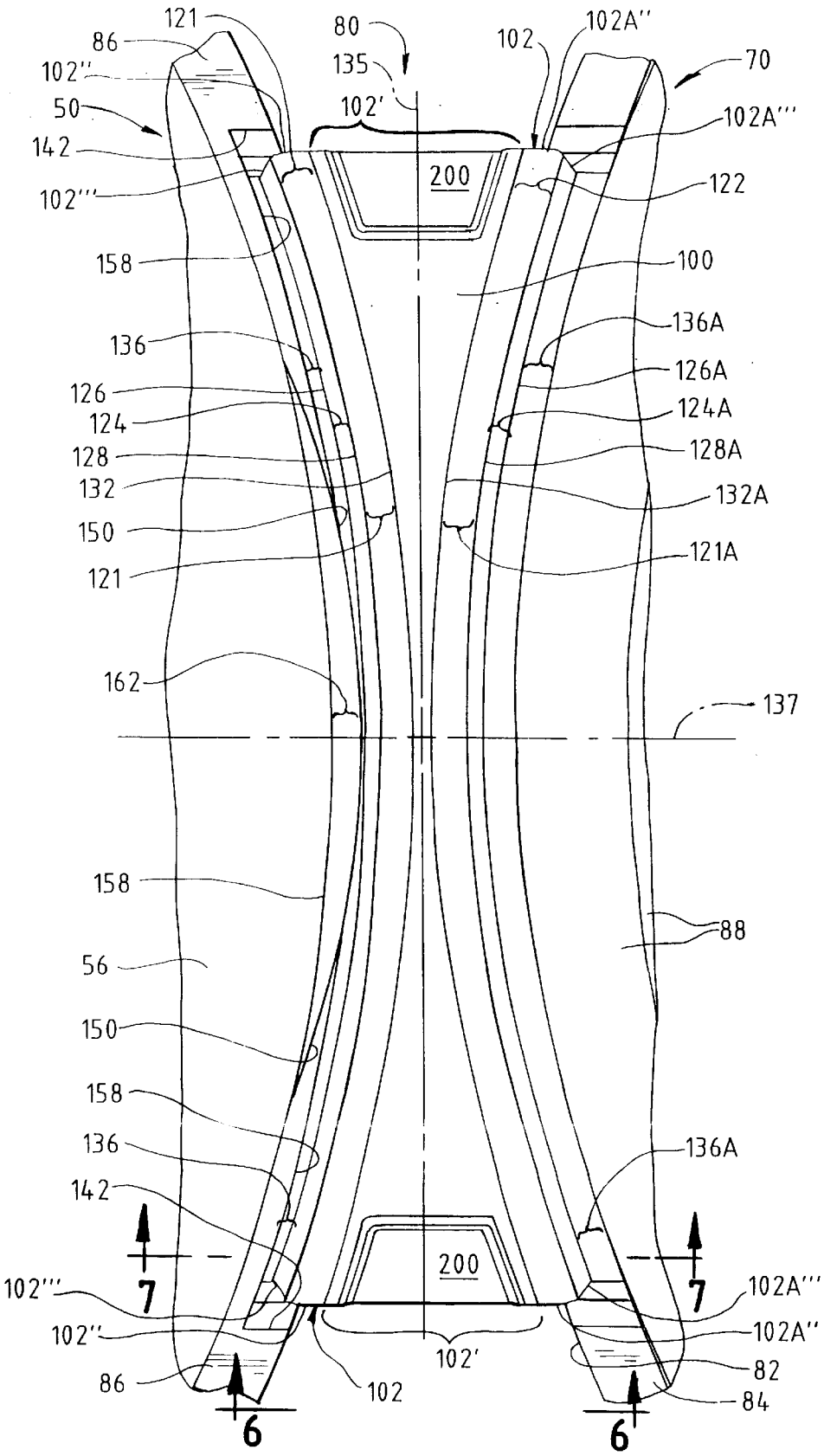
FIG. 4 is a greatly enlarged, fragmentary, top plan view of the hinge structure region of the closure shown in the fully open, as-molded condition, and the plan view is taken generally along the plane 4—4 in FIG. 3.
Figure 5:
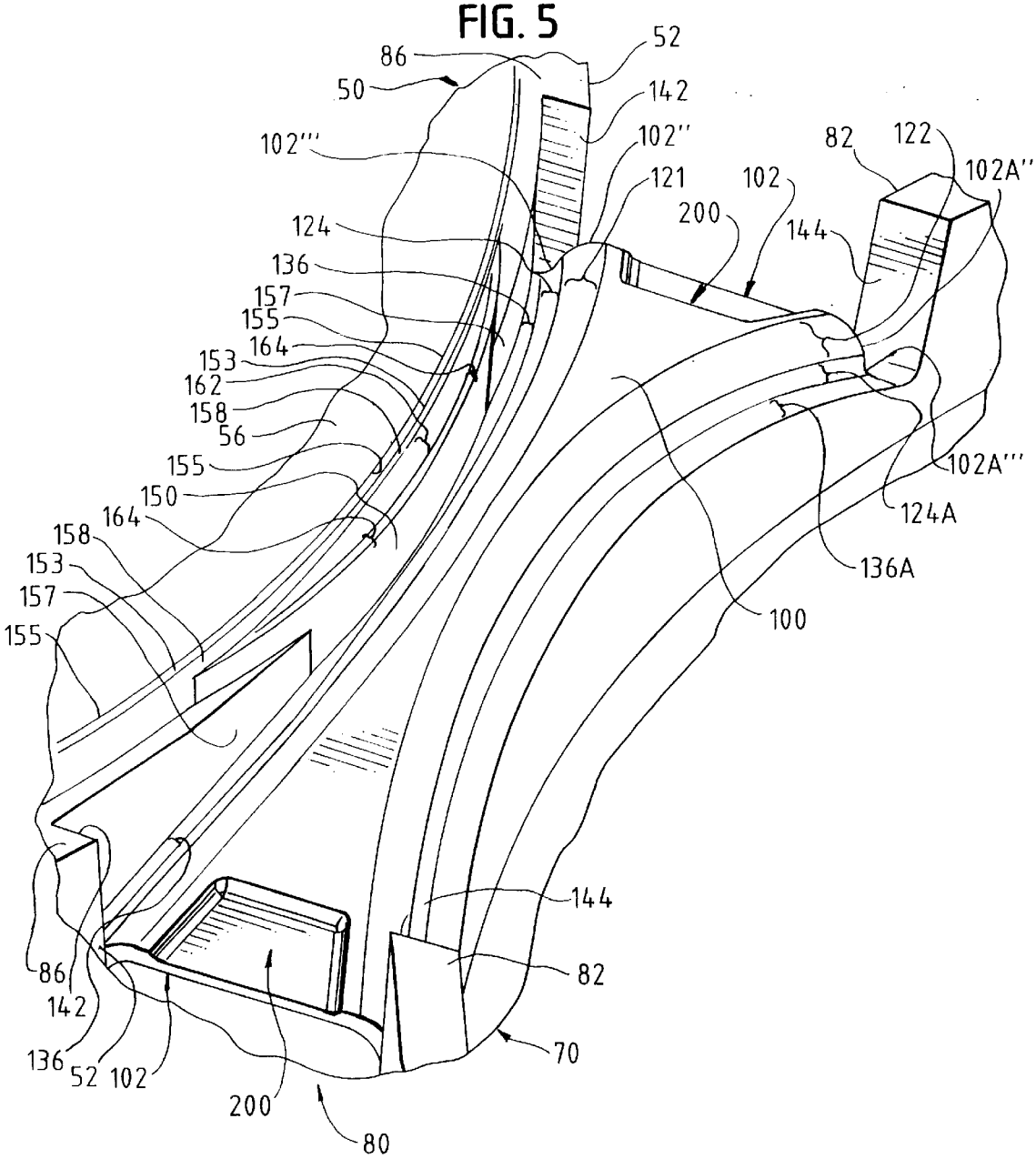
FIG. 5 is a fragmentary, perspective view of the hinge structure shown in FIG. 4.

As illustrated in FIGS. 4 and 5, the hinge structure 80 includes a web 100 having a central, narrow portion between two wider ends 102. The two ends 102 are generally parallel in the preferred embodiment illustrated. The hinge structure 80 includes basic features disclosed in U.S. Pat. No. 5,642,824 which is incorporated herein by reference thereto to the extent not inconsistent herewith.

Figure 8:
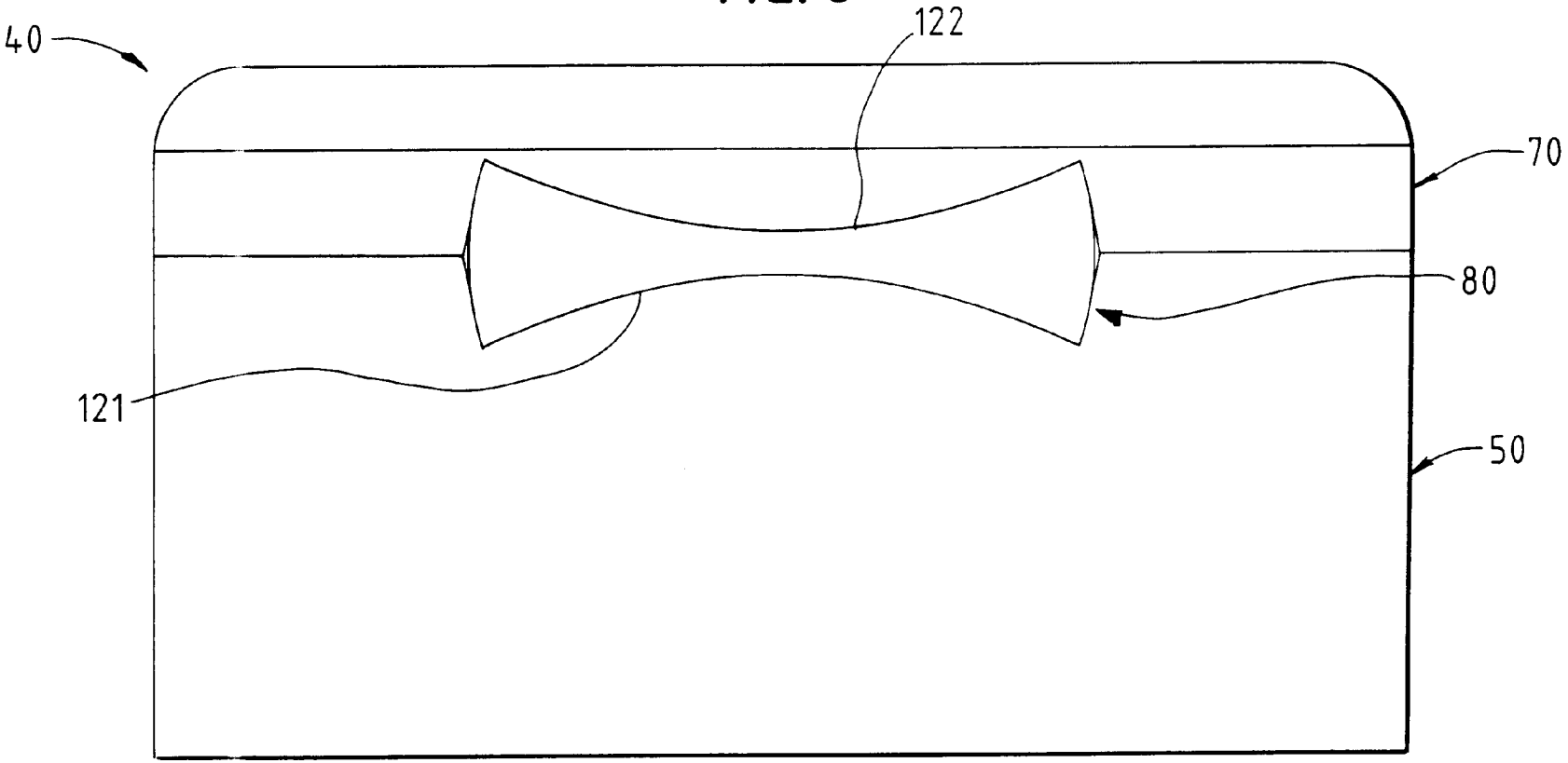
FIG. 8 is a rear elevational view of the closure in the fully closed condition to show the closed hinge structure.

A first, arcuate hinge 121 connects the base 50 to the web 100 along one side of the web 100 between the ends 102. A second, arcuate hinge 122 connects the lid 70 to the web 100 along another side of web 100 between the ends 102. As illustrated in FIG. 4, the first hinge 121 lies on an arc concentric with the arc defining an adjacent peripheral portion of the closure base 50, and the second hinge 122 lies on an arc defining an adjacent peripheral portion of the lid 70. As illustrated in FIG. 8, the first hinge 121 lies in an upwardly convex curve on the side of the closure base 50. As illustrated in FIG. 8, the second hinge 122 lies on an upwardly concave curve on the side of the closure lid 70.

In a preferred embodiment as illustrated in FIG. 8, the inner surface of the first hinge 121 has a particular configuration when the lid is fully open. Specifically, with reference to FIG. 6, the inner surface of the first hinge 121 (when the lid is fully open) has a curved, radius surface defined between the arcuate line 128 and another arcuate line 132. Adjacent to the base side of the hinge 121 there is a radius surface 124 defined between the arcuate line 128 and an arcuate line 126. The arcuate line 126 defines the locus of tangency between the radius surface 124 and an adjacent shoulder surface 136 on the base 50. The arcuate line 128 defines the locus of tangency between the radius surface 124 and the radius surface of the first hinge 121. The arcuate line 132 defines the locus of tangency between the radius surface of the first hinge 121 and the adjacent portion of the web 100.

In a preferred, contemplated commercial embodiment wherein the closure 40 is fabricated from polypropylene, the radius of the surface 124 is 0.01 inch, the radius of the upwardly facing inner surface of the hinge 121 (as viewed in FIG. 4) is 0.03 inch, and the thickness of the web 100 is 0.012 inch.

The second hinge 122 has a configuration generally identical to that of the first hinge 121, except that the second hinge 122, of course, is oriented in the opposite direction to connect the web 100 to the lid 70. When the lid is fully opened (FIG. 7), the inner surface of the second hinge 122 has a curved, radius surface defined between an arcuate line 128A (FIG. 4) and an arcuate line 132A (FIG. 4). Along the lid side of the second hinge 122 there is radius surface 124A (FIG. 4). The radius surface 124A is defined the between the arcuate line 128A and an arcuate line 126A.

The arcuate line 126A defines the locus of tangency between the radius surface 124A and an adjacent shoulder 136A on the lid 70. The arcuate line 128A defines the locus of tangency between the radius surface 124A and the adjacent radius surface of the second hinge 122. The line 132A defines the locus of tangency between the radius surface of the second hinge 122 and the adjacent portion of the web 100.

The second hinge 122 preferably has the same configuration and dimensions as the first hinge 121. Therefore, the radius of surface 124A and the radius of the surface of the hinge 122 are equal to the radius of surface 124 and the radius of the surface of the first hinge 121, respectively.

Figure 7:
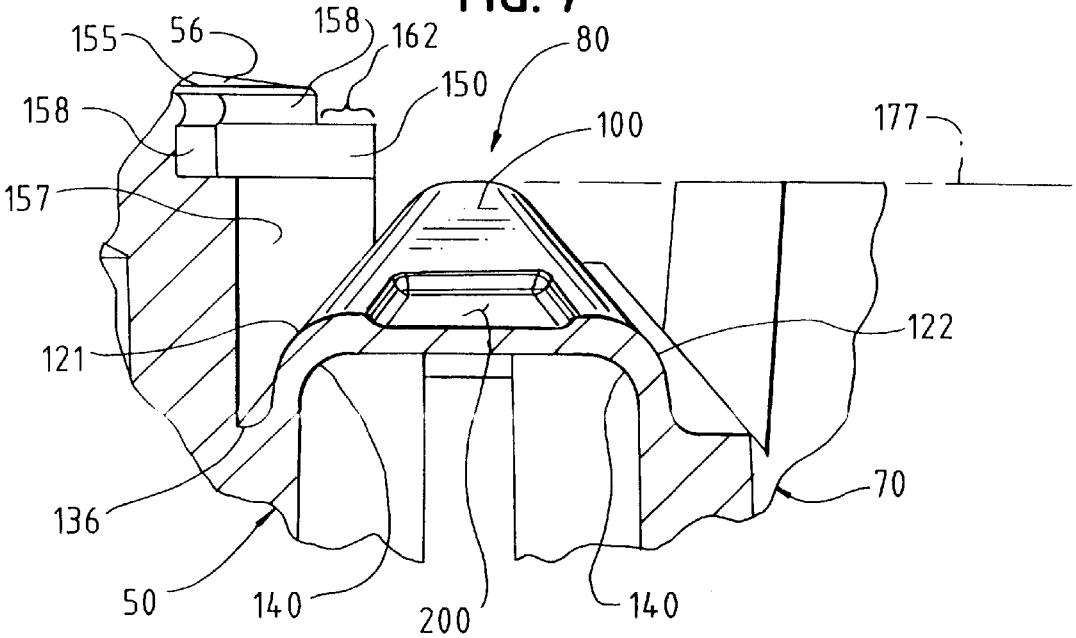
FIG. 7 is a fragmentary, cross-sectional view taken generally along the plane 7—7 in FIG. 4.

With reference to FIG. 7, when the lid 70 is fully open, the radius surface on the outside of each hinge 121 and 122 along the exterior of the web 100 is designated by the reference numeral 140. In a preferred, contemplated commercial embodiment, the radius of the surface 140 is about 0.012 inch, but at the center of the hinge the radius is 0.010 inch and at each lateral edge the radius is 0.015 inch with the radius gradually increasing from the center to the two lateral edges.

The hinge structure 80 is accommodated in the closure base 50 by a notch 142 defined in the closure base skirt 52 (FIG. 5). Similarly, the hinge structure 80 is accommodated in the closure lid 70 by a notch 144 in the closure lid skirt 82 (FIG. 5).

Preferably, the web 100 is substantially symmetric about a centerline 135 (FIG. 4). Another line 137 is perpendicular to the centerline 135 and passes through the centers of the closure base 50 and closure lid 70. The distance between the centerline 135 and the intersection of the line 137 with the hinge 121 equals the distance between the centerline 135 and the intersection of the line 137 with the hinge 122.

Typically, the maximum outside dimensions of the shoulder 86 on the closure base skirt 52 is about 0.01 inch greater than the corresponding maximum outside dimensions of the lid skirt 82 at the lid skirt confronting surface 84. As a consequence, the midpoint of the hinge structure 80 along the line 137 is offset slightly toward the lid 70 compared to the point mid-way between the centers of the lid 70 and base 50 (on the intersection of line 137).

The central portion web 100 of the hinge structure 80 is narrower than the two ends 102. The widest part of the hinge structure 80 occurs at each end 102. Preferably, the widths of the two ends 102 are equal. A major portion of the width of each end 102 is defined by a straight line segment 102' when the lid 70 is in the full open condition. The straight line segment 102' is symmetrically disposed relative to the longitudinal centerline 135 of the hinge structure 80. At each end of the segment 102', the end of the first hinge 121 is defined by an edge 102", and the end of the second hinge 122 is defined by an edge 102A". The edges 102" and 102A" slant or curve slightly toward the centerline 137 of the closure, which centerline 137 passes through the centers of the closure base 50 and closure lid 70.

Each end of the radius surface 124 is defined by an edge 102'", and each end of the radius surface 124A is defined by an edge 102A'''. Each edge 102''' and 102A''' curves or slants from the edge 102'' and 102A'', respectively, so that the edges 102''' and 102A''' join the surfaces 136 and 136A, respectively, at an orientation that is substantially parallel to the closure centerline 137 joining the centers of the closure base and lid. When the lid 70 is closed (FIG. 8), the stress tends to cause a slight curvature of each end segment 102'.

In the preferred embodiment illustrated in FIGS. 1–8, the shoulder 136 decreases in width from each end of the hinge structure 80 toward the middle of the hinge structure 80 where the width of the shoulder 136 becomes very small or, preferably, substantially disappears. This occurs because an abutment surface 150 (FIG. 5) is provided for controlling the position of the web 100 upon the closing or opening of the lid 70. In the preferred embodiment illustrated, the abutment surface 150 is molded as a unitary part of the closure base 50.

The abutment surface 150 projects outwardly from the closure base 50. The closure base 50 has wall portions 157 (FIGS. 4 and 5) which each extends from one end of the notches 142 and merges with the abutment surface 150. The closure base 50 also has a generally vertically oriented, arcuate surface 158 (FIGS. 4 and 5) which extends from the top surface of the shoulder 86 and beyond the top of the abutment surface 150. The arcuate surface 158 extends around the periphery of the closure base deck 56, and the peripheral shoulder 86 projects outwardly therefrom on either side of the abutment surface 150.

In FIG. 5, arcuate line 155 defines an upper edge of a radius surface at the top of the surface 158, and arcuate line 153 defines a lower edge of a radius surface at the top of the surface 158.

The abutment surface 150 projects outwardly from the surface 158 as shown in FIGS. 4, 5, and 7. A horizontal ledge 162 is defined at the top of the abutment surface 150 and projects from the arcuate surface 158. The outer edge of the ledge 162 is defined by a convex radius surface 164 (FIG. 5) which merges with the vertical abutment surface 150. In a presently contemplated commercial embodiment, the surface 164 has a radius of about 0.01 inch.

The arcuate hinge 121 is spaced below the deck 56, below the ledge 162 at the top of the abutment surface 150, and below the closure base shoulder surface 86.

In the region of the hinge structure 80, the closure base notch 142 in the closure base wall 52 is defined along its bottom by the shoulder 136 (FIGS. 4, 5, and 7) which decreases in width toward the center of the hinge structure 80. Adjacent the central portion of the hinge structure 80, the width of the shoulder surface 136 decreases to nearly zero as the protruding abutment surface 150 projects further outwardly into the surface 136.

The radius of the arcuate surface 158 (at the outer edge of the deck 56 adjacent the hinge structure 80) is larger than the radius of the exterior, vertical surface of the abutment surface 150. Moreover, both the inner and outer radii of the shoulder 136 are larger than the radius of the exterior, vertical surface of the abutment surface 150.

The abutment surface 150 is defined by an arcuate surface which is preferably positioned symmetrically relative to the web ends 102 so that the surface 150 projects outwardly from the cylindrical surface 158 into the shoulder 136. In the preferred illustrated embodiment, the abutment surface 150, at the centerline 137 of the hinge structure 80, may be characterized as extending both (1) upwardly to an elevation above the base shoulder surface 86, and (2) downwardly along a vertical line to the shoulder 136 slightly below the first hinge 121.

The ledge 162 at the top of the abutment surface 150 is recessed below the upper surface of the base deck 56. The elevation of the abutment ledge 162 is established so that when the lid 70 is closed, the lid shoulder surface 136A (FIGS. 4 and 5) will not interfere with the abutment surface ledge 162.

The abutment surface 150 establishes a vertically oriented abutment beyond which the hinge web 100 cannot move when the lid 70 is closed and opened. The abutment surface 150 controls the position of the hinge structure web 100 upon the closing and opening of the lid 70. Preferably, the abutment surface 150 has a vertical height, at the location along the center of the hinge structure 80 (on the centerline 137 of the centers of the closure base 50 and lid 70), which is at or above the second hinge 122 when the lid 70 is fully closed. In other words, at the longitudinal center of the hinge structure 80 (on centerline 137), the abutment surface 150 extends upwardly above hinge 121 for a distance that is greater than the shortest distance between the hinges 121 and 122.

Upon the closing or opening of the lid 70, the hinge structure web 100 engages the abutment surface 150 so that the position of the web 100 is controlled as described in more detail in U.S. Pat. No. 5,642,824. In general, the web 100 bows inwardly toward and against the abutment surface 150 when the lid 70 is partially closed. The abutment surface 150 should preferably extend adjacent the web central portion 100 from the first hinge 121 toward the second hinge 122 (when the lid is closed) more than one-half the shortest distance between the hinges (as measured at the centerline 137 between the web ends 102). However, preferably, the abutment surface 150 at the centerline 137 of the hinge structure 80 extends all the way to, and slightly beyond, the hinge 122 when the lid 70 is closed, and this is presently believed to provide the most accurate control.

The radial extent of the projecting abutment surface 150 can be easily varied during manufacturing according to the hinge characteristics that are desired for a particular application. If the abutment surface 150 projects outwardly a considerable amount, then the hinge structure web 100 contacts the abutment surface 150 earlier during the closing process. If the projection of the abutment surface 150 is less, then the hinge structure web 100 would contact the abutment surface 150 later in the closing process, or only when the lid is substantially 100 percent closed.

When the abutment surface 150 projects further outwardly, the biasing action of the hinge structure 80 can be made greater to provide an opening and closing action with more "snap" or force. When the projection of the abutment surface 150 is reduced, the biasing force can be made less, and the opening and closing action of the closure will be "softer." Further, when the abutment surface 150 projects further outwardly, the full open position of the lid 70 defines a greater opening angle relative to the closure base 50 than if the abutment surface 150 projects outwardly a lesser amount.

In a presently contemplated commercial embodiment, the radius of the abutment surface 150 is 0.553 inch and the diameter of the arcuate surface 158 from which it projects is about 1.320 inch. The height of the abutment surface 150 (at the ledge surface 162) is 0.03 inch from the molding parting plane 177 (FIG. 7) defined by the inner surface of the hinge web 100 when the lid is in the as-molded, fully opened position. In contrast, in the contemplated commercial embodiment, when the lid 70 is in the closed position, the lowest part of the second hinge 122 (at the centerline 137 between the hinge web ends 102) would be 0.005 inch lower than the abutment surface ledge 162. Thus, the abutment surface 150 extends upward slightly beyond the lowest point of the lid hinge 122 when the lid 70 is closed.

The incorporation of the abutment surface 150 in the hinge structure 80 of the present invention is not a necessary part of the present invention. The hinge structure of the present invention may be employed with other hinge structures that do not employ the abutment surface 150 and/or that employ a fixed center hinge pivot between the two spaced-apart hinges 121 and 122.

Generally, in a presently contemplated commercial embodiment, it is desired to provide a hinge structure 80 in which the strain in the hinge structure 80 is not too much when the lid 70 is in the fully closed position. This minimizes the tendency of the hinge structure 80 to loose its snap-action biasing capability when the lid 70 is maintained closed for long periods of time in the fully closed position.

In alternate designs wherein the hinge structure 80 would have a greater amount of strain when the lid 70 is in the fully closed position, the strain could, over time, result in some creep of the closure material and subsequent relaxation. This would reduce the amount of biasing force that the hinge structure would exert during opening and closing of the lid.

The operation of the hinge structure 80, in so far as the structure has been described herein, is described in detail in the U.S. Pat. No. 5,642,824. Generally, as the hinge structure 80 is moved from the opened to the closed position, and vice versa, the changes in the distance between the hinges 121 and 122 near the ends 102 relative to the smaller changes in the distance between the hinges 121 and 122 at the centerline 137 create a significant tension force or "stretch" at the outer most ends 102. This causes the hinge structure 80 to be unstable in any position between the full open and full closed positions.

This results in the hinge structure 80 having an inherent bias (when the lid is between the full open and full closed positions). This urges the hinge structure 80 to assume one of the two bistable positions (either full open or full closed).

The stretch or tension in the hinge structure 80 serves to create a temporary deformation within the hinge structure that is sufficient to move the lid 70 automatically toward the closed position or toward the open position when it is released from any position between the full open and full closed positions. The lid will automatically move to the full closed position if it is released while it is initially closer to the full closed position. On the other hand, the lid will automatically move to the full open position if the lid is released from an initial position which is closer to the full open position.

It will be appreciated that the full open orientation of the closure illustrated of the figures corresponds to the initial, as-molded position. This as-molded position preferably has the base and lid opened 180°. Once the lid 70 is first closed and the lid is thereafter opened and maintained free of any exterior forces, the hinge structure will typically maintain the lid in an open position which has an opening angle somewhat less than the substantially 180° opening angle of the original, as-molded, open orientation.

According to the present invention, the hinge structure 80 is configured to provide a selected stress or particular distribution of stress along the outer, lateral edges 102 of the web 100. In particular, it has been found that the reduction of the web thickness at the regions 200 increases the stress at the midpoint of, and along, each lateral edge 102 adjacent to the region 200. This causes a reduction in stress where the edges 102 connect to the closure body 50 and closure lid 70. It is in these connection locations where failure or fracture of the hinge structure 80 is most likely to initiate. Thus, a reduction in the stresses at these four points of the hinge structure 80 will reduce the likelihood of the failure of the hinge structure 80.

In one presently contemplated embodiment of the structure 80, the web 100 includes two spaced-apart regions 200 (FIGS. 4–7) which define a reduced thickness in the web between, and relative to, the hinges 121 and 122.

Preferably, each region 200 extends laterally to the adjacent lateral edge 102.

In a presently preferred embodiment, the web 100 has a generally uniform thickness between the hinges 121 and 122, and each region 200 of reduced thickness results in a reduction of the web thickness of about one third.

In the preferred embodiment illustrated in FIGS. 1–7, the web 100 may be characterized as having (1) an inside surface facing toward the closure base and lid (when the lid is in the closed position), and (2) an outside surface oppositely facing from the inside surface, and each reduced thickness region 200 is defined on the web inside surface by a generally trapezoid shaped recess having one side along one of the lateral edges 102. The depth of the recess in the illustrated preferred embodiment is about one third of the thickness of the adjacent, uniform thickness portion of the web 100. It is contemplated that in a polypropylene hinge structure where the generally uniform thickness portion of the web has a thickness between about 0.010 inch and 0.015 inch, and preferably about 0.012 inch, the preferred range of the thickness of the reduced thickness part of the web is at least about ½ or more of the thickness of the adjacent, uniform thickness portion of the web.

Figure 6:
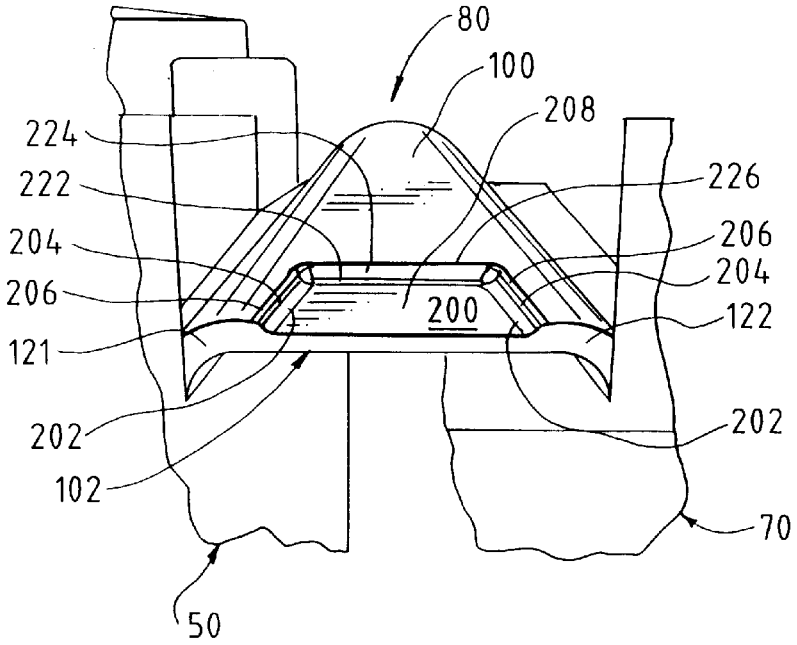
FIG. 6 is a fragmentary, elevational view taken generally along the plane 6—6 in FIG. 4.

As can be seen in FIG. 6, each trapezoid shaped recess at each region 200 includes two sides which are each parallel to an adjacent hinge 121 or 122, and each of those sides includes a lower arcuate surface 202, an intermediate straight surface 204, and an upper arcuate surface 206. The lower arcuate surface 202 merges on one side with a generally planar bottom surface defining the bottom of the recess and merges on the other side with the straight surface 204. The upper, arcuate surface 206 merges on one side with the straight surface 204 and on the other side with the upper, exposed, inside surface of the web 100 as shown in FIG. 6.

As shown in FIG. 6, the width of the reduced thickness region 200 is defined on one end by a side which is generally parallel to the web lateral edge 102, and that end is defined by a bottom, arcuate surface 222, by an intermediate straight surface 224, and by an upper arcuate surface 226. The bottom arcuate surface 224 merges on one side with the planar bottom wall 208 of the reduced thickness region 200 and merges on the other side with the straight surface 224. The upper, arcuate surface 226 merges on one side with the straight surface 224 and on the other side with the exposed, upwardly facing, inner surface of the web 100. The curved surfaces 202, 206, 222, and 226 function to reduce stress concentrations within the web at the bottom and top edges of the recess inwardly of the web lateral edge 102.

However, the actual stress at the midpoint of the length of the web lateral edge 102 adjacent to the reduced thickness region 200 is greater than the stress at the midpoint of the web edge in a prior art hinge web (e.g., as shown in U.S. Pat. No. 5,642,824) which has either a substantially uniform thickness or an increased thickness along the edge between the hinges. The stress along the lateral edge 102 of the web 100 is greatest at the midpoint of the length of the lateral edge 102, and the stress decreases outwardly from the center portion of the lateral edge 102 toward the hinges 121 and 122. The greater stress at the center of each lateral edge 102 reduces the stresses where the web 100 connects with the hinges 121 and 122 at both of the lateral edges 102. The stress reductions at these four points on the hinge structure minimize the likelihood of hinge failure initiating at these points.

Figure 9:
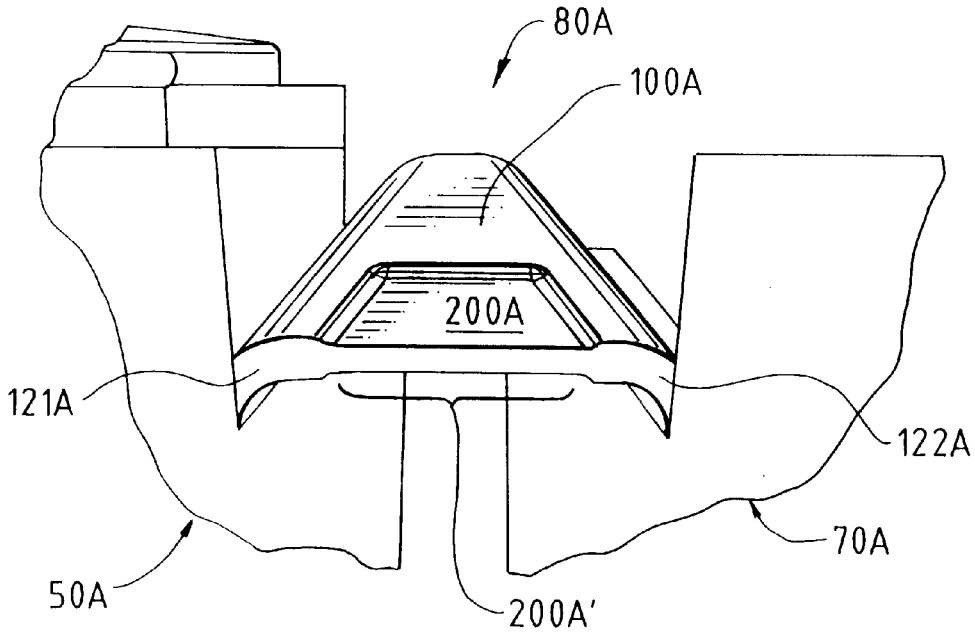
FIG. 9 is a view similar to FIG. 6, but FIG. 9 shows a second embodiment of the hinge structure.

A second embodiment of a hinge structure 80A is shown in FIG. 9 as incorporated in a closure having a closure base 50A and a lid 70A. The hinge structure 80A includes a web 100A joined to the closure base 50A with a hinge 121 A and joined to the closure lid 70A with a hinge 122A. In the second embodiment of the hinge structure 80A, the web 100A includes a first region 200A of reduced thickness on one side of the web and a second region 200A' on the other side of the web 100A. Each region 200A and 200A' preferably has the same configuration as the region 200 described above for the first embodiment with reference to FIGS. 1–8.

Figure 10:
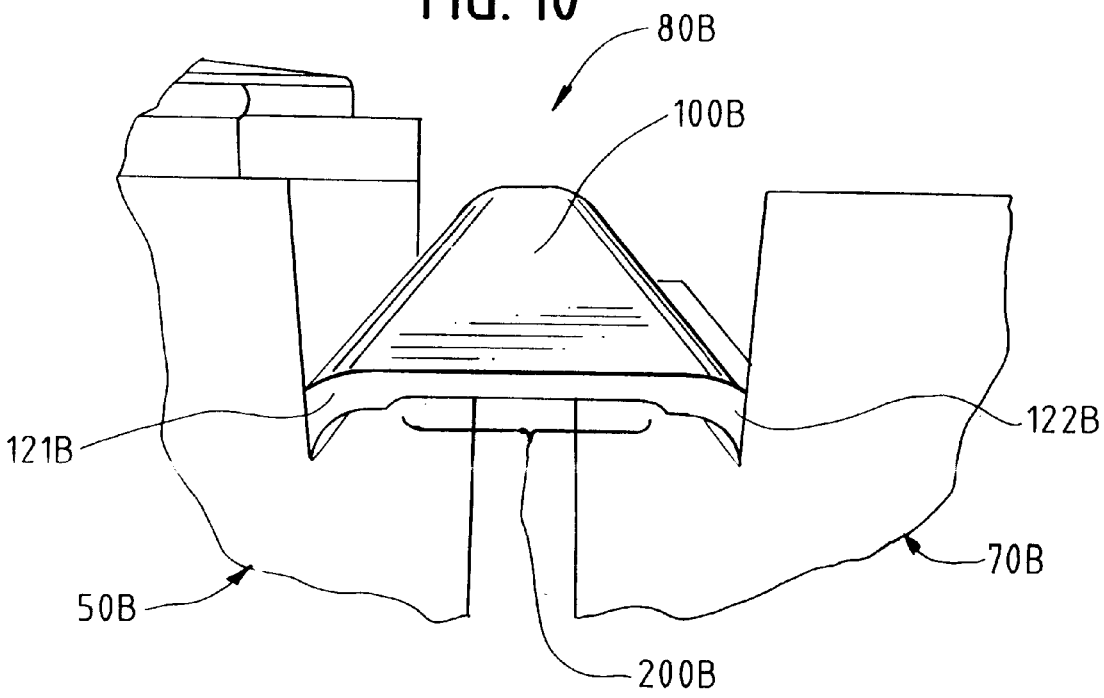
FIG. 10 is a view similar to FIG. 6, but FIG. 10 shows a third embodiment of the hinge structure.

FIG. 10 illustrates a third embodiment of the hinge structure 80B incorporated in a closure having a closure base 50B and a closure lid 70B. The hinge structure 80B includes a web 100B joined on one side with a hinge 121B to the closure base 50B and joined on the other side to the closure lid 70B with a hinge 122B. The hinge structure 80B is substantially identical with the second embodiment of the hinge structure 80A described above with reference to FIG. 9 except that the third embodiment of the hinge structure 80B does not include the upper reduced thickness region 200A. The third embodiment of the hinge structure 80B only includes a bottom recess or reduced thickness region 200B which preferably has the same configuration as the recess 200A' described above with reference to the second embodiment of the hinge structure 80A illustrated in FIG. 9.

In still other embodiments (not illustrated), the hinge structure may include a fixed, central axis and two spaced-apart triangular shaped webs.

Each web is located at an end of the axis and is oriented with an apex of the web at the axis end. Each web has a lateral edge opposite the apex at the fixed axis, and each web has a reduced thickness region adjacent the lateral edge.

It will be appreciated that the shapes of the reduced thickness regions (such as regions 200 in the first embodiment of the hinge structure illustrated in FIGS. 1–8) may be altered to provide varying degrees of effect on producing a more uniform distribution of stress along each lateral edge of the hinge web. Thus, this permits control of the amount of stress reduction at the four regions in the hinge structure where the lateral edges of the web are connected to hinges. The stress reduction is of particular importance in any condition of the hinge structure wherein the hinge structure is subjected to stress during normal operation, such as when the hinge structure is moved away from its initially, as-molded, condition.

Typically, the hinge structure is initially molded in a fully opened condition. That is, when such a hinge structure is initially molded as part of a closure, the closure is molded with the lid in an initially open condition. After molding, the closure hinge structure is substantially stress-free. Stresses are developed within the hinge structure when the hinge structure is moved away from its initially molded, open condition (e.g., when the closure lid is moved away from the open condition toward the closed condition. The stress in the hinge structure reaches a maximum at the "over center" point (i.e., at an intermediate position between the closed and opened positions). The stress in the closure hinge structure is reduced somewhat when the lid has been moved to the fully closed position, but the hinge structure remains under sufficient stress to bias the lid to, and hold the lid at, the closed position. It is during the movement of the closure lid away from the fully opened condition toward the closed condition that the increased stresses can cause failure of the hinge. Because the present invention reduces the hinge operational stresses at the four regions of the hinge web corners at the two hinges, the hinge structure can be designed to accommodate many cycles of opening and closing without failure and/or can be designed with less material and/or with less expensive, but lower strength, materials.

It is seen that the present invention thus provides an improved hinge structure which is especially suitable for use in a closure which has a lid wherein it is desired that the lid operate with a snap-action motion while moving to and from a closed position.

The hinge structure protrudes minimally from the rear of the closure when the closure lid is in the closed position. This is compatible with high speed closure applying machinery employed in conventional container product filling lines. This permits the closure to be used with containers processed at high line speeds.

It will be appreciated that a closure incorporating the hinge structure of the present invention provides a system for covering an opening to a container with a closure having a base and lid connected with a multiple axis bistable hinge structure or with a single, fixed axis bistable hinge structure. The hinge structure can incorporate a web and an engaging abutment surface which can be designed to provide a small or large biasing force and a small or large lid opening angle.

It will also be appreciated that the closure may be provided with a variety of dispensing passage structures.

Further, a closure incorporating the hinge structure of the present invention need not be molded as a unitary article. The hinge structure could be molded as a separate element, and the lid and base could also be molded as separate pieces. The separate hinge structure could then be attached (e.g., by welding, adhesive, mechanical snap-fit, etc.) to the lid and base. The optional abutment surface, if employed, could be molded as part of the separate hinge structure element or it could be molded as part of the lid or base. However, if the abutment surface is molded as part of the lid or base while the web and hinges are molded together as an element separate from the lid and base, then the abutment surface may nevertheless still be characterized as being a functional, but separate, part of the hinge structure per se.

It will be readily observed from the foregoing detailed description of the invention and from the illustrations thereof that numerous other variations and modifications may be effected without departing from the true spirit and scope of the novel concepts or principles of this invention.

What is claimed is:

1. A bistable, snap-action hinge structure for connecting two members, said hinge structure comprising:

a continuous structure molded unitary with the two members to include (a) a web having a narrow portion and at least one wider end which defines a lateral edge, (b) a hinge that connects one of the members to said web along one side of said web, and (c) a hinge that connects the other of the members to said web along another side of said web, each said hinge bending to permit said web to move through a range of orientations relative to said member, said web having a reduced thickness region, said reduced thickness region extending to said lateral edge and having a reduced thickness at said lateral edge relative to the thickness of adjacent portions of said web at said lateral edges.

2. The hinge structure in accordance with claim 1 in which a major portion of said web lateral edge is defined by a generally straight line segment when said hinge structure is fully opened.

3. The hinge structure in accordance with claim 1 in which said reduced thickness is defined on one side surface of said web.

4. The hinge structure in accordance with claim 1 in which said reduced thickness region is defined by a generally trapezoid shaped recess having one side along said lateral edge.

5. The hinge structure in accordance with claim 1 in which said web has a substantially uniform thickness except for said reduced thickness region which has a reduced thickness which is at least about ½ or more of the thickness of the adjacent, uniform thickness portion of the web.

6. A hinge structure for a closure for a container opening wherein said closure includes (1) a base for mounting to said container over said opening and defining a discharge aperture communicating with said opening, and (2) a lid movable between a closed position occluding said aperture and an open position spaced from said aperture, said hinge structure comprising:

a bistable, snap-action hinge structure molded as a continuous structure unitary with the base and lid to include (a) a web having a central, narrow portion between two wider ends which each defines a lateral edge, (b) an arcuate hinge that connects said base to said web along one side of said web between said lateral edges, and (c) an arcuate hinge that connects said lid to said web along another side of said web between said lateral edges, each said hinge bending to permit said web to move through a range of orientations relative to said base and lid, said web having two spaced-apart reduced thickness regions, each said reduced thickness region extending to one of said lateral edges and having a reduced thickness at said lateral edge relative to the thickness of adjacent portions of said web at said lateral edges.

7. The hinge structure in accordance with claim 6 in which said hinge structure includes at least one abutment surface located so that when said lid is in said closed position the abutment surface (1) extends adjacent said web central portion from one of said hinges toward the other hinge, and (2) contacts said web central portion whereby the position of said web is controlled upon the closing and opening of said lid.

8. The hinge structure in accordance with claim 7 in which said abutment surface is unitary with said base;

said base has (1) a cylindrical surface with a first radius, and (2) a recessed shoulder projecting from said cylindrical surface adjacent said web ends for accommodating seating of said lid thereon when said lid is in said closed position;

said abutment surface extends outwardly from said cylindrical surface adjacent said web central portion; and said abutment surface is defined by a cylindrical arc surface having a second radius less than said first radius.

9. The hinge structure in accordance with claim 6 in which said closure is molded from one of the group of materials consisting of polypropylene and polyethylene.

10. The hinge structure in accordance with claim 6 in which said base and lid each have an exterior wall which defines a notch for accommodating said web.

11. The hinge structure in accordance with claim 6 in which a major portion of each of said web lateral edges is defined by a generally straight line segment when said hinge structure is fully opened; and said straight line segments are generally parallel.

12. The hinge structure in accordance with claim 6 in which the shortest distance between said two hinges is located along a line midway between said web end lateral edges.

13. The hinge structure in accordance with claim 6 in which each said hinge, when the lid is in the open position, defines a radius surface; and said hinge structure includes an adjacent radius surface tangent to each said hinge radius surface.

14. A hinge structure in accordance with claim 6 in which said web is free of apertures.

15. The hinge structure in accordance with claim 6 in which said web has an (1) inside surface facing toward said base and lid when said lid is in said closed position, and (2) outside surface oppositely facing from said inside surface; and each said reduced thickness region is defined on said web inside surface.

16. The hinge structure in accordance with claim 15 in which each said reduced thickness region is defined by a generally trapezoid shaped recess having one side along one of said lateral edges.

17. The hinge structure in accordance with claim 6 in which said web has a substantially uniform thickness except for said reduced thickness regions which each has a reduced thickness which is at least about ½ or more of the thickness of the adjacent, uniform thickness portion of the web.

* * * * *